US007891024B2

(12) United States Patent
Garofalo et al.

(10) Patent No.: US 7,891,024 B2
(45) Date of Patent: Feb. 22, 2011

(54) DIVING MASK AND METHOD FOR THE MANUFACTURE THEREOF

(75) Inventors: Giovanni Garofalo, Rapallo (IT); Gian Paolo Vaccaro, Rapallo (IT)

(73) Assignee: HTM SPORT S.p.A., Rapallo (IT)

( * ) Notice: Subject to any disclaimer, the term of this patent is extended or adjusted under 35 U.S.C. 154(b) by 237 days.

(21) Appl. No.: 11/287,290

(22) Filed: Nov. 28, 2005

(65) Prior Publication Data

US 2006/0117469 A1 Jun. 8, 2006

(30) Foreign Application Priority Data

Dec. 3, 2004 (IT) ..... GE2004A0108

(51) Int. Cl.
*A61F 9/02* (2006.01)

(52) U.S. Cl. ..... 2/426; 2/439

(58) Field of Classification Search ..... 128/206.21, 128/206.23, 205.25, 200.29, 201.11, 201.12, 128/201.22; 2/426–428, 430, 431, 439–450; 405/185–187

See application file for complete search history.

(56) References Cited

U.S. PATENT DOCUMENTS

| | | | | |
|---|---|---|---|---|
| 2,333,336 | A | 11/1943 | Powell | |
| 2,524,245 | A | 10/1950 | Wold | |
| 4,087,865 | A | 5/1978 | Garofalo | |
| 4,755,040 | A | 7/1988 | Haslbeck | |
| 5,553,331 | A | 9/1996 | Gentile | |
| 5,764,332 | A | 6/1998 | Kranhouse | |
| 6,253,387 | B1 | 7/2001 | Yu | |
| 2004/0143889 | A1 | 7/2004 | Chou | |
| 2004/0226080 | A1 * | 11/2004 | Shiue | 2/426 |
| 2005/0120468 | A1 | 6/2005 | Kawashima et al. | |

FOREIGN PATENT DOCUMENTS

| | | |
|---|---|---|
| GB | 2 347 629 | 9/2000 |
| WO | WO-2005/016467 | 2/2005 |

OTHER PUBLICATIONS

Molding Solutions: "Rubber Engineering Guide-Rubber Tolerances & Rubber Compounds" 'Online!' Feb. 24, 2003, Rubber Manufacturers Association, Washington D.C., Retrieved from the Internet: URL: http://web.archive.org/web/20030224154744/http://www.molders.com/rubber_engineering_guide.html on Jul. 27, 2005.

* cited by examiner

*Primary Examiner*—Tatyana Zalukaeva
*Assistant Examiner*—Kristen C Matter
(74) *Attorney, Agent, or Firm*—Stites & Harbison PLLC; Marvin Petry; Stephen J. Weyer

(57) ABSTRACT

A diving mask which includes a face-piece having, formed therein, one or more openings for housing one or more lenses, means for fixing the lenses inside the face-piece, and means for connecting the mask to the diver's head. The face-piece is formed by at least two portions which are stably connected together, where the two portions are respectively made using two materials which are different at least from the point of view of the rigidity, with one of the two materials being more rigid than the other one.

13 Claims, 3 Drawing Sheets

DIVING MASK AND METHOD FOR THE MANUFACTURE THEREOF

BACKGROUND AND SUMMARY OF THE INVENTION

The present invention relates to diving masks as well as to a method for the manufacture thereof.

A diving mask comprises usually a face-piece having, formed therein, one or more openings for housing one or more lenses, a frame for fixing the lenses inside the face-piece and a strap for connecting the mask to the diver's head.

When manufacturing face-pieces for diving masks it has always been necessary to achieve a compromise between various requirements which often tend to conflict with each other.

So for instance, in a diving mask it is requested:

(a) that the rim of the mask which is in contact with the face of the scuba diver be as much as possible soft in order to ensure maximum comfort and sealing capacity;

(b) that the portion of the mask lying beneath the rigid frame, and in which are formed the openings housing the lenses, be formed with a certain structural solidity which may be achieved only with relatively more rigid materials, in order to avoid that, if too soft, this portion could be withdrawn from beneath the frame if subjected to a certain tensile stress for example when putting on the mask;

(c) that the portion of the mask covering the nose of the diver be as much as possible soft in order to facilitate the compensation manoeuvre by avoiding at the same time that the underlying rim portion be twisted, thus facilitating the infiltration of water in the mask.

While initially in this technical sector the most common material used for manufacture of the face-piece of the mask was without doubt natural rubber, nowadays the elastomers which are most widely used are silicones, fluorosilicones, fluoro hydrocarbon rubbers such as Viton™, neoprene, acrylonitrile-butadiene rubber and ethylene-propylene rubber. Of these, the elastomers which are most versatile in terms of their rigidity range are silicones, which may have a hardness of between 5 and 90 degrees Shore A (ISO 868). In addition to this, silicones have notable properties as regards chemical inertia and tolerance by the user, which make them even more suitable for this type of processing operation.

It remains a problem, however, that, despite notable progress achieved in relation to the materials during recent decades, the rigidity of the elastomer material used is today still the result of a compromise between the two opposing sets of requirements mentioned above.

From the prior art, and for instance from US-A1-2004/143889; U.S. Pat. No. 4,087,865; U.S. Pat. No. 6,253,387 B1 and US-A1-2005/120468 swim goggles are known obtained by the combination of two different compositions of materials having different hardness. However, in the swim goggles: (1) the portion covering the nose of the diver is missing, and therefore all problems mentioned before sub (c) are missing; and (2) since the swim goggles are formed by two distinct and disjoint eye pieces which are applied on the ocular orbits, also the problem of the peripheral seal mentioned sub (a) is missing.

The object of the present invention is therefore to provide a mask, the face-piece of which is able to satisfy fully both the needs of a structural nature and those relating to sealing capacity and comfort.

The present invention therefore relates to a diving mask comprising a face-piece having, formed therein, one or more openings for housing one or more lenses, means for fixing the lenses inside the face-piece and means for connecting the mask to the diver's head; said face-piece is formed by at least two portions, which are stably connected together, said two portions being respectively made using two materials which are different at least from the point of view of the rigidity, one of the two materials being more rigid than the other one.

Said materials are elastomer materials such as for example silicones, fluorosilicones, fluoro hydrocarbon rubbers, neoprene, acrylonitrile-butadiene rubber and ethylene-propylene rubber and, of these, silicones are preferred, in particular liquid silicone rubbers (LSR) having a hardness of between 10 and 70 degrees Shore A.

In one embodiment, the portions of the face-piece of the mask intended to come into direct contact with the diver's face are made with a softer material, while the other materials are made of more rigid material. The softer material will be an elastomer material with a hardness of between 10 and 40 Shore A, while the more rigid material will have a hardness of between 40 and 70 Shore A.

The materials chosen for the different portions may preferably belong to the same class of compounds so as to improve their chemical bonding capacity during assembly of the face-piece; alternatively, the various portions of the face-piece will be made so as to ensure an adequate mechanical union between them.

The present invention furthermore relates to a method for the manufacture of face-pieces for diving masks, comprising the formation of the face-piece as at least two portions, said portions being made using at least two different materials, preferably elastomers, having a varying rigidity. The face-mask may be made by means of injection-moulding and the different portions may be made by means of successive over-moulding of the softer portions onto the more rigid portions; alternatively, moulding may be performed by means of twin injection, forming the more rigid portions and the softer portions substantially at the same time.

By this method it is also possible to colour in different manners the two elastomeric compositions, in order to provide an individualising aspect to the thus obtained mask.

BRIEF DESCRIPTION OF THE DRAWINGS

Further advantages and characteristic features of the mask according to the present invention will become clear from the following detailed description of some embodiments thereof, provided, by way of a non-limiting example, with reference to the plates of accompanying drawings in which.

DESCRIPTION OF THE PREFERRED EMBODIMENTS OF THE INVENTION

Figure 1:
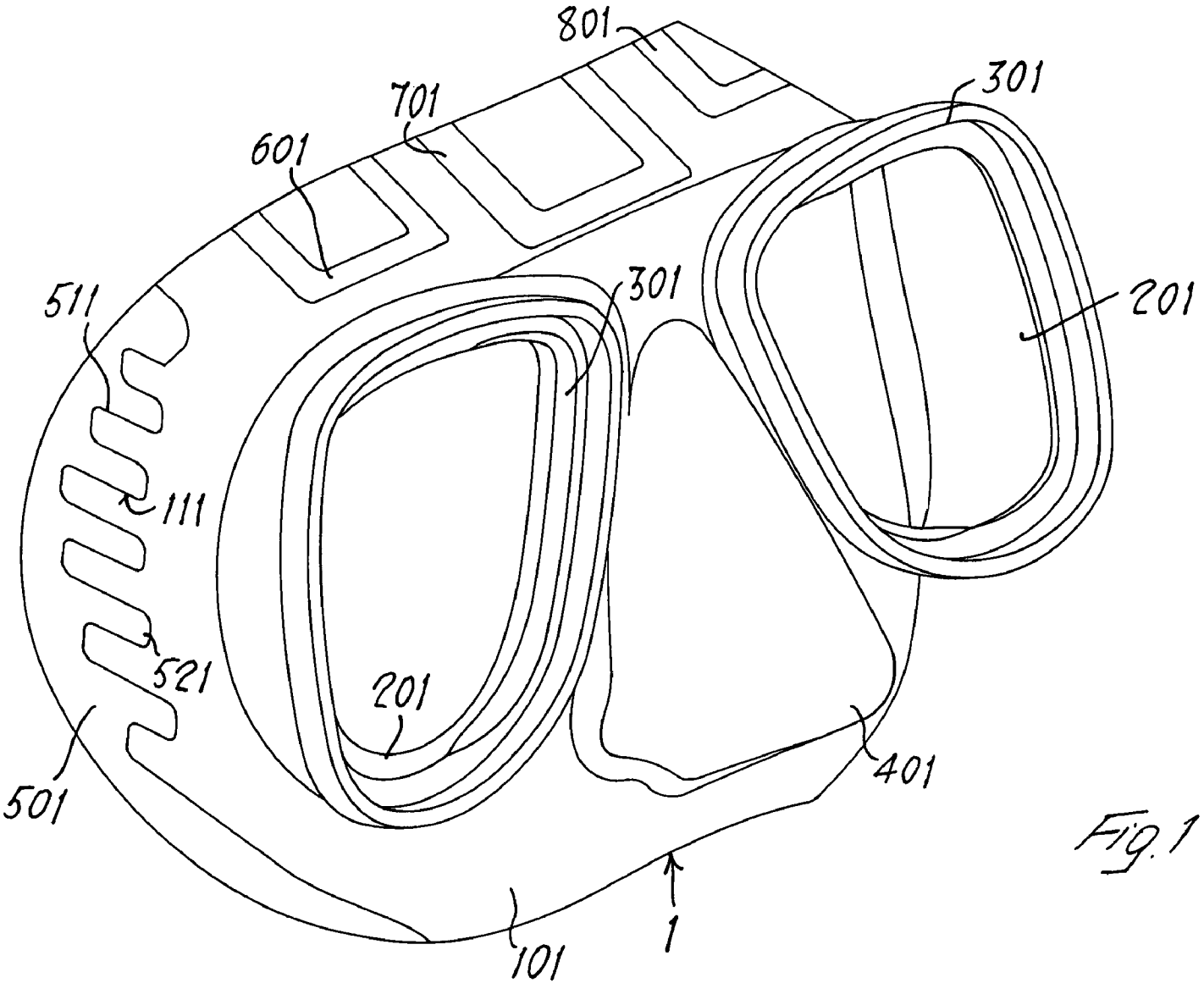
FIG. 1 is a perspective view of a first embodiment of a face-piece of a diving mask according to the present invention.

In FIG. 1 the reference number 1 denotes a rubber face-piece of a mask according to a first embodiment of the present invention. Said face-piece is formed, as is usual, by a body, or body portion, 101 which is made of relatively more rigid material and having, formed therein, two openings 201 which are able to house lenses for the mask, which are not shown in the Figure. The outer edge of the said openings 201 has shaped seals 301 which allow water-tight positioning of the said lenses; an enclosure, or nose portion, 401 for the diver's nose is also envisaged. The edge of the body which the nasal enclosure engages may be referred to as a front edge of the body. The outer edge of the body 101 of the face-piece, and in particular the temporal edges of this body, which may also be referred to as a rear edge, have, arranged along them, a rim portion 501 which is stably connected to the said body and is made of relatively softer material. The sealing line 111 between an edge of the rim portion 501 and the rear edge of the body portion 101 is provided with a series of reliefs and recesses 511, 521 located on the temple side of the mask. In the rear edge of said body 101, the body accommodates the inserts 601, 701 and 801, which are all substantially U-shaped; these inserts are stably connected to the body 101 and are also made of material which is relatively softer than that of the body 101. As shown generally at 50 in cross sectional views, FIGS. 4 and 5, an edge of the rim portion joins the rear edge of the body portion in such a manner as to form a continuation of the continuous surface of the body portion. As also shown generally in the cross sectional views, FIGS. 4 and 5, at 55, the nose portion loins a front edge of the body portion so as to form a continuation of the continuous surface of the body portion.

Figure 3:
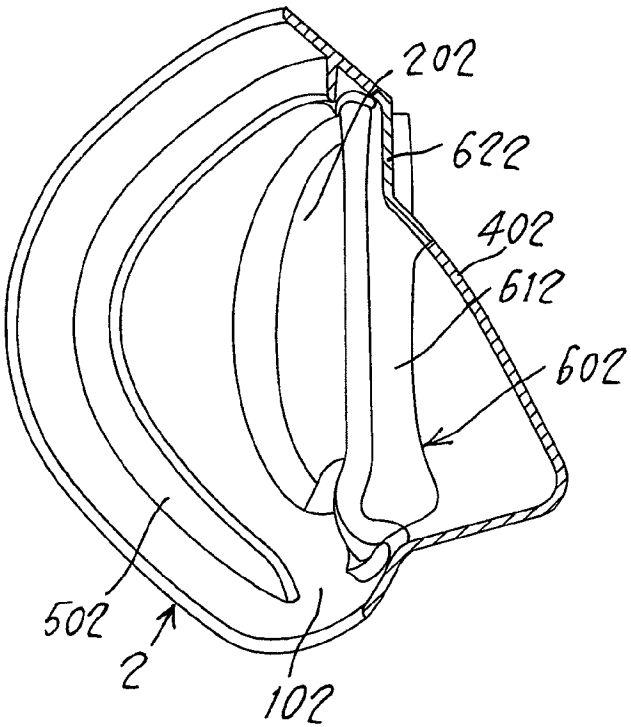
FIG. 3 is a view sectioned along the line III-III of FIG. 2.
Figure 2:
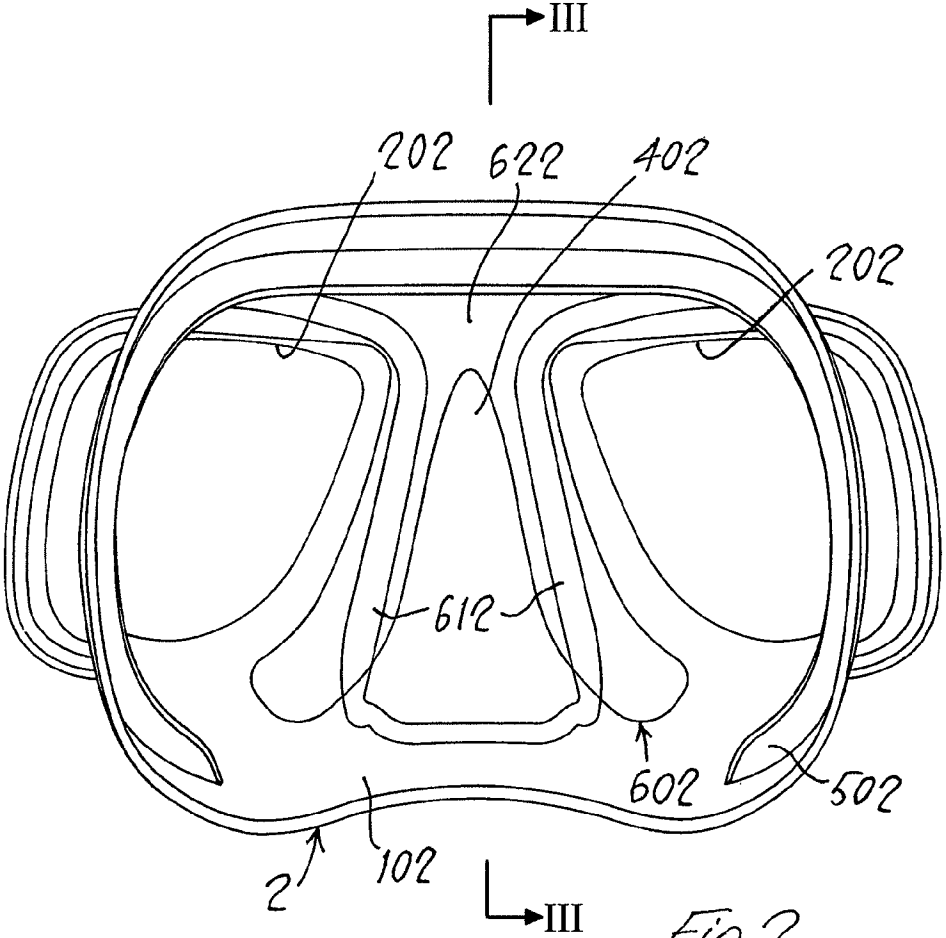
FIG. 2 is a rear elevation view of a second embodiment of the invention.

FIG. 2 shows a second embodiment of the invention; the face-piece 2 shown here has a body 102 where it is possible to distinguish the openings 202, the nasal compartment 402 and the sealing lip 502 situated in the vicinity of the outer edge of the said body. The portion 602, which comprises two peri-nasal parts 612 and a front part 622 which is substantially transverse with respect thereto, is inserted inside the body 102 of the face-piece and made of material which is relatively softer than that from which it is made. In FIG. 3, where identical parts are indicated by the same numbers, it is possible to see the arrangement of the portion 602 inside the body 102 sectioned along the line III-III in FIG. 2.

Figure 5:
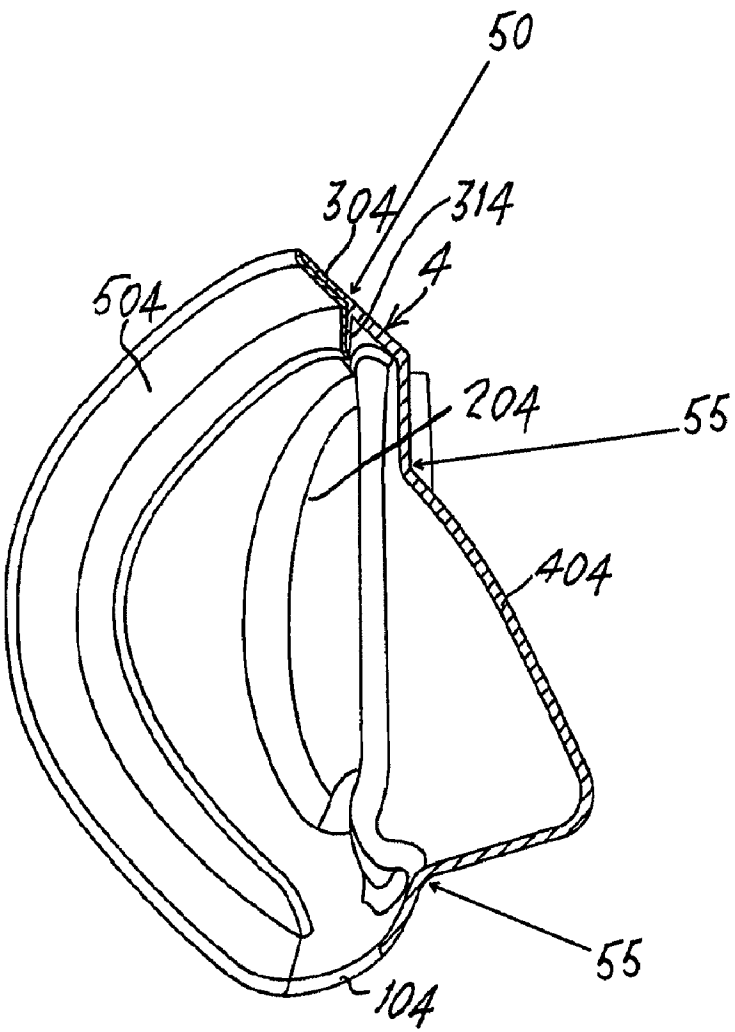
FIG. 5 is a cross-sectional view of a constructional variant of the embodiment according to FIG. 4.
Figure 4:
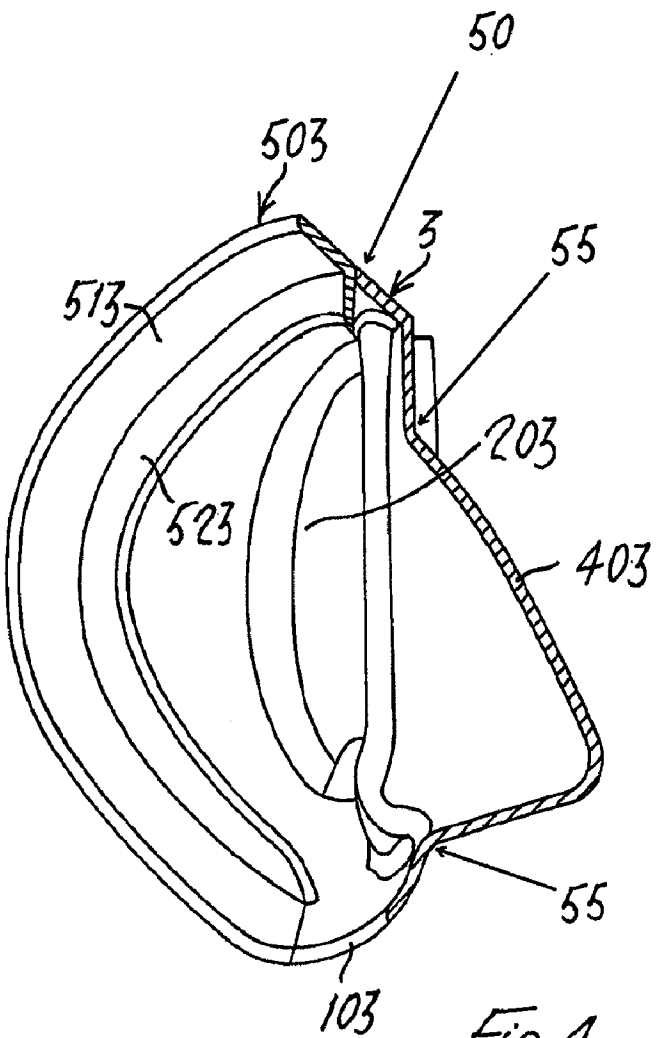
FIG. 4 is a cross-sectional view of a third embodiment of the invention.

FIG. 4 shows a cross-sectional view of a third embodiment of the invention; the face-piece 3 comprises the body 103 in which the openings 203 are formed and which is provided with the nasal compartment 403. The body 103 has, joined thereto, the portion 503 which is made of softer material and comprises the outer edge 513 and the sealing lip 523. In FIG. 5, which shows a variation of the embodiment of the mask according to FIG. 4, the body 104 of the face-piece 4 has the openings 204 and the nasal compartment 404, and the portion 504 of softer material 504 is joined to the outer edge 304 and the sealing lip 314.

The operating principle of the mask according to the present invention and the method for manufacture thereof will become clear from the description below. With reference to the Figures of the accompanying drawings, the face-piece of the diving mask according to the present invention comprises in general portions made of more rigid material and portions made of softer material; the latter are preferably situated in the zones where there is a greater need for a good sealing capacity, such as the temporal outer edge of the portion 501 in FIG. 1 or the portion 503 in FIG. 4 or the portion 504 in FIG. 5. Alternatively, the said portions of softer material may be used in areas where it is required to provide a better degree of comfort for the diver, as in the case of the portion 602 of the embodiment shown in FIG. 2. In this case the positioning of a softer portion on the front and along the sides of the nasal compartment allows an improvement in the wearing comfort in zones which are typically subject to the greatest pressure load.

The face-piece of the mask according to the present invention may be manufactured using different methods; preferably it will be made by means of injection-moulding of the portions of more rigid material and the portions of softer material in immediately successive steps. Advantageously, the face-piece of the mask is obtained by means of twin injection-moulding performed using the so-called "rotating table" method. The zones forming the interface between the various portions made using the various material may be designed so as to favour bonding from a mechanical point of view, such as for example the series of reliefs 511 and recesses 521 shown in FIG. 1 along the line 111 joining together the portion 501 and the body 101. Optionally, the various materials may be coloured or pigmented in a different way so as to provide the face-piece with one or more different colours, with an obvious appreciable aesthetic effect.

The elastomer materials used to manufacture the face-piece of the mask may be those which are more typically used for these purposes and in particular are chosen from among the materials which have a hardness ranging between 10 and 70 degrees Shore A. In particular, elastomers with a hardness ranging between 40 and 70 Shore A will be used for the portions of relatively more rigid material, while elastomers with hardness values of between 10 and 40 Shore A will be used for the portions of relatively softer material.

The preferred materials are silicones, fluorosilicones, fluoro hydrocarbon rubbers, neoprene, acrylonitrile-butadiene rubber and ethylene-propylene rubber and, of these, silicones and in particular liquid silicone rubbers (LSR) are preferred. The more rigid material and the softer material may be chosen on the basis of their respective mechanical properties and it is also preferable that there is a high degree of chemical compatibility between the more rigid material and the softer material so that joining together of the two materials occurs in an extremely effective manner.

Advantageously, the two materials will belong to the same class of compounds, and in particular both the more rigid material and the softer material are silicones, and preferably they are both liquid silicone rubbers.

The mask thus designed offers considerable improvements from the point of view of both comfort and sealing capacity, and the manufacture thereof, considering the optimum results achieved, does not appear to be particularly complex and intricate.

The invention claimed is:

1. A diving mask comprising:

a body portion formed of a material of a given rigidity, the body portion having a continuous surface including a front edge and a rear edge, the body portion having formed therein openings for the mounting of one or more lenses, a rim portion having an edge bonded to the rear edge of the body portion and shaped to engage the user's head, a surface of the rim portion forming a continuation of the continuous surface of the body portion, the rim portion formed of a material softer than the given rigidity of the body portion, and a nose portion bonded to the front edge of the body portion and shaped to cover the user's nose, a surface of the nose portion forming a continuation of the continuous surface of the body portion, the nose portion formed of a material softer than the given rigidity of the body portion.

2. The diving mask of claim 1, wherein the nose portion is made of an elastomer having a hardness between 10 and 40 Shore A.

3. The diving mask of claim 1, wherein the body portion material and the rim portion material are composed of an elastomer material selected from the group consisting of silicones, fluorosilicones, fluoro hydrocarbon rubbers, neoprene, acrylonitrile-butadiene rubber and ethylene-propylene rubber.

4. The diving mask of claim 1, wherein the body portion material and the rim portion material are both silicones.

5. The diving mask of claim 4, wherein the silicones are liquid silicone rubbers.

6. The diving mask of claim 5, wherein the body portion material and the rim portion material have a degree of hardness ranging between 10 and 70 Shore A.

7. The diving mask of claim 1, wherein the rim portion material comprises an elastomer material having a hardness between 10 and 40 Shore A and the body portion material has a hardness between 40 and 70 Shore A.

8. The diving mask of claim 7, wherein the body portion material and the rim portion material have a high degree of chemical compatibility.

9. The diving mask of claim 1, wherein the body portion comprises a series of projections and valleys which mate with complementary valleys and projections, respectively, of the rim portion.

10. The diving mask of claim 1, wherein the body portion and the rim portion comprise a respective plurality of complementary projections which interdigitate with one another at an interface between the body portion and the enclosure portion.

11. The diving mask of claim 10, wherein the plurality of complementary projections are located on at least one of a temple side of the body portion and the rim portion.

12. The diving mask of claim 1, wherein the body portion comprises at least one cut-out, and located in said cut-out is an insert comprising a material less rigid than a material of the body portion.

13. The diving mask according to claim 1, wherein the bonding of the rim portion and/or the nose portion to the body portion is by chemical bonding.

* * * * *